US006298964B1

(12) United States Patent
Sadow

(10) Patent No.: US 6,298,964 B1
(45) Date of Patent: Oct. 9, 2001

(54) ROLLING CASE

(75) Inventor: Bernard David Sadow, Chappaqua, NY (US)

(73) Assignee: Outrigger, Inc., Chappaqua, NY (US)

( * ) Notice: Subject to any disclaimer, the term of this patent is extended or adjusted under 35 U.S.C. 154(b) by 0 days.

(21) Appl. No.: 09/362,984

(22) Filed: Jul. 28, 1999

Related U.S. Application Data

(63) Continuation-in-part of application No. 09/140,964, filed on Aug. 27, 1998, now abandoned.

(51) Int. Cl.[7] ..... B65D 5/14

(52) U.S. Cl. ..... 190/18 A; 190/115; 280/37; 280/655.1

(58) Field of Search ..... 190/115, 18 A; 280/47.26, 47.17, 47.2, 37, 655.1; 16/113.1

(56)

References Cited

U.S. PATENT DOCUMENTS

| | | | |
|---|---|---|---|
| 3,606,372 | | 9/1971 | Browning . |
| 3,790,232 | | 2/1974 | Alvarez . |
| 3,995,802 | | 12/1976 | Johnston . |
| 4,087,102 | | 5/1978 | Sprague . |
| 4,261,447 | | 4/1981 | Arias et al. . |
| 4,538,709 | | 9/1985 | Williams et al. . |
| 4,759,431 | | 7/1988 | King et al. . |
| 4,982,820 | | 1/1991 | Scott . |
| 5,160,001 | | 11/1992 | Marceau . |
| 5,197,579 | | 3/1993 | Bieber et al. . |
| 5,217,119 | | 6/1993 | Hollingsworth . |
| 5,228,546 | | 7/1993 | Chang et al. . |
| 5,230,408 | | 7/1993 | Sadow . |
| 5,339,934 | | 8/1994 | Liang . |
| 5,351,792 | | 10/1994 | Cohen . |
| 5,377,795 | | 1/1995 | Berman . |
| 5,407,039 | | 4/1995 | Alper et al. . |
| 5,445,266 | | 8/1995 | Prete et al. . |
| 5,447,216 | | 9/1995 | Freyvogel . |
| 5,474,162 | | 12/1995 | Shyr et al. . |
| 5,476,163 | | 12/1995 | Wu . |
| 5,494,157 | | 2/1996 | Golenz et al. . |
| 5,511,806 | | 4/1996 | McNair . |
| 5,524,754 | | 6/1996 | Hollingsworth . |
| 5,529,184 | | 6/1996 | Sadow . |
| 5,564,538 | | 10/1996 | Sadow . |
| 5,566,797 | | 10/1996 | Van Himbeeck . |
| 5,573,089 | | 11/1996 | Liang . |
| 5,575,362 | | 11/1996 | Franklin et al. . |
| 5,622,262 | | 4/1997 | Sadow . |
| 5,630,602 | * | 5/1997 | Vanderslice et al. ..... 190/280 |
| 5,645,146 | | 7/1997 | Bieber et al. . |
| 5,676,223 | | 10/1997 | Cunningham . |
| 5,813,504 | | 9/1998 | Iny et al. . |
| 5,918,710 | * | 6/1999 | Sher ..... 190/115 X |
| 6,098,768 | * | 8/2000 | Tsai ..... 190/115 X |

FOREIGN PATENT DOCUMENTS

| | | |
|---|---|---|
| 2005520 | 9/1971 | (DE) . |
| 587630 | 5/1977 | (DE) . |
| 3636064A | 4/1988 | (DE) . |
| 0005879 | 12/1979 | (EP) . |
| 1292341 | 3/1961 | (FR) . |
| 2409720 | 6/1979 | (FR) . |
| 693373 | 7/1953 | (GB) . |

* cited by examiner

*Primary Examiner*—Allan N. Shoap
*Assistant Examiner*—Tri M. Mai
(74) *Attorney, Agent, or Firm*—Abelman, Frayne & Schwab

(57) ABSTRACT

A portable carrying case for a laptop computer is disclosed which may be readily converted into a rolling case. This conversion is accomplished with minimal additional weight or bulk, by a retractable handle which extends into, and through, the interior of the case, and while not in use, may be disconnected from the case. A narrow elongated roller is mounted along the bottom edge of the laptop carrying case for transporting the case along the ground surface. The narrow elongated roller may also be removed from the case when it is desired to utilize the case in a non-rolling mode of operation.

20 Claims, 9 Drawing Sheets

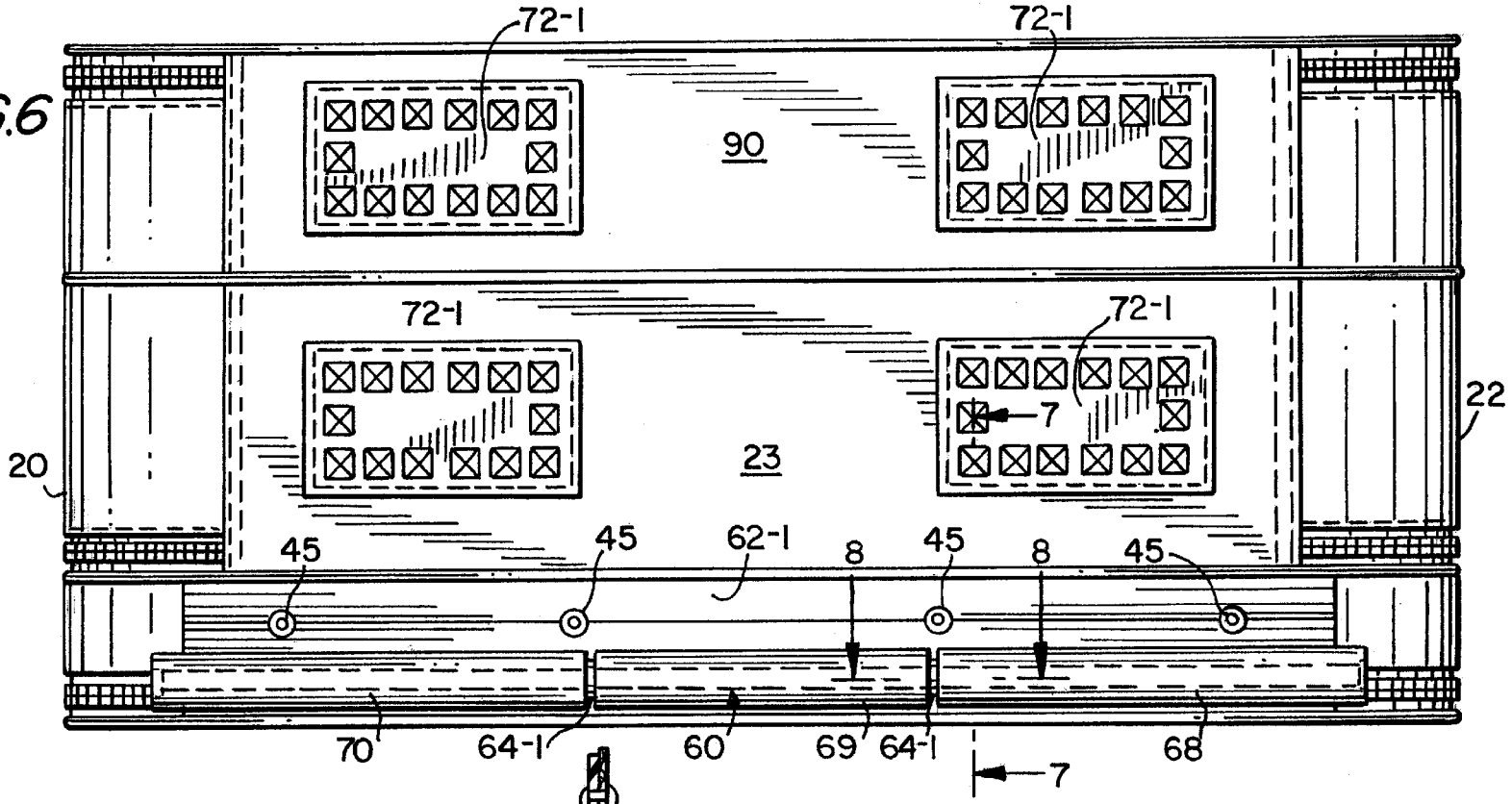
FIG.6
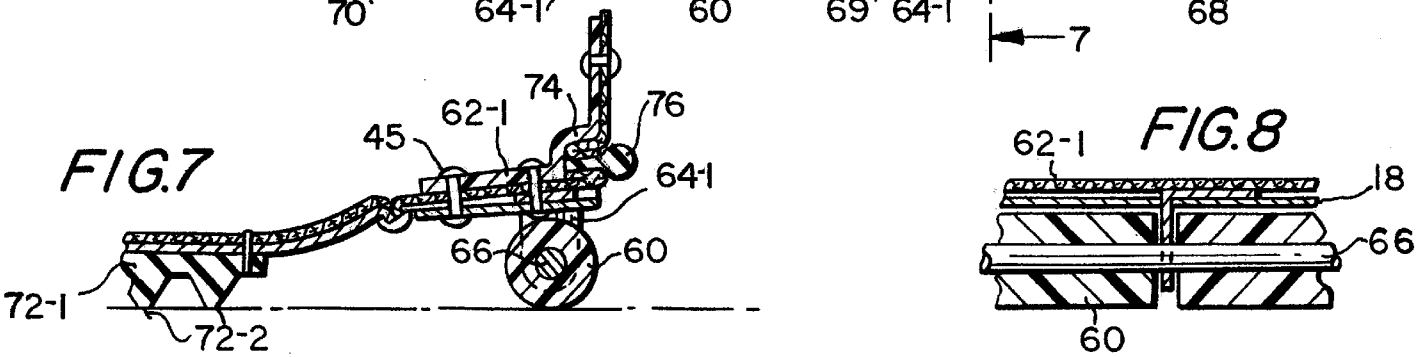
FIG.8
FIG.7

102
40-1C
101
40-1B
14
92
93
97
94
95
96
45-2
93
91
40-1A
40-1A

ROLLING CASE

RELATED APPLICATION

This is a continuation-in-part of Ser. No. 09/140,964 filed on Aug. 27, 1998 and is being abandoned in conjunction with the filing of this application.

FIELD OF INVENTION

This invention relates to a compact carrying case for a laptop computer, briefcase, portfolio, attache case, or similar cases, which includes a narrow roller along its bottom wall, and a retractable handle which extends into, and through the interior of, the carrying case and can readily be inserted into or removed from the case to permit conversion of the case between its carrying mode and rolling mode along a floor surface.

BACKGROUND OF THE INVENTION

The increased prevalence and utilization of laptop computers and other readily transportable devices have led to the development of a variety of portable carrying cases to enable the user to safely and protectively transport the laptop computer or other contents. Such laptop computer carrying cases are usually slightly larger than the laptop computer, formed of fabric or other soft material, and include appropriate cushioning material to protect the laptop computer against jarring or dropping. Typical carrying cases are shown in U.S. Pat. Nos. 5,217,119 5,445,266 5,494,157 and 5,524,754. Such carrying cases as well as briefcases, portfolios, and attache cases usually include a manually graspable handle. A shoulder strap may also be provided in order to permit the user to lift and tote the carrying case during his or her travels. Such shoulder straps or manually graspable handles may be sufficiently convenient for carrying the case during short periods of time (e.g. during local commuting or within the user's building) or when the user is not carrying other baggage. However, during prolonged periods of carrying the case containing a laptop computer or many files, particularly when traveling in conjunction with other articles of luggage, it may be inconvenient and/or uncomfortable to restrict the transport of the laptop computer case by lifting with the shoulder strap or manually graspable handle.

SUMMARY OF THE INVENTION

In accordance with the present invention a compact, lightweight, and unobtrusive construction is provided to readily convert the portable carrying case to a rolling mode. The structure for converting the case includes a retractable handle which extends into and through the interior of the carrying case and may be manually disconnected from the carrying case. When disconnected the handle assembly may be either (i) stored in the carrying case, or (ii) completely removed from the carrying case. Advantageously, the portable carrying case includes a handle storage compartment along one of its outer walls. The handle storage compartment includes a manually operable closure means, such as a zipper, or other means, such as a flap with a snap or Velcro closure, so that when the handle is in its retracted stored position and not removed from the carrying case, it will be completely confined within the case. In conjunction with the retractable handle, an elongated roller assembly, which will preferably be of a significantly lesser diameter than the individual wheels conventionally attached to wheeled articles of luggage, is mounted to the bottom of the carrying case. The elongated roller may also be preferably removed from the carrying case when it is not in the rolling mode. When it is desired to convert the portable carrying case for rolling operation, the previously removed retractable handle is manually re-attached to the carrying case, moved out from within the volume of the case, such that its free end extends upwardly beyond the top wall of the case. If the roller assembly had been removed, the roller assembly is also manually attached to the bottom of the carrying case to place the case in its rolling mode. The removable handle assembly, in conjunction with the narrow roller assembly which may also be removable, allows the portable carrying case to function as a conventional case, utilizing its shoulder strap or manually graspable handle, while maintaining the aesthetics of the case without significantly increasing the profile of the case.

The retractable handle may be formed of a single, or pair of interconnected, vertical extensible members, generally centrally located between the end walls of the case and comprised of a plurality of telescoping sections which extend into the interior volume of the case. Each of the sections is of a length less than the height of the handle storage compartment between the top and bottom walls of the case. Thus, the telescoping retractable handle, although removable, may be completely confined within the handle storage compartment in its connected and retracted position.

In accordance with my invention the retractable handle assembly may be completely removed from the case when it is desired to use the case in a non-rolling mode. A releasable means is provided for securing the retractable handle to the case. The releasable means may be manually moveable between a first condition in which the retractable handle is engaged and fixedly secured to a wall of the case and a second condition wherein the retractable handle may be removed from the case. When it is desired to use the case in the non-rolling mode for a substantial period of time the removed handle may be stored in a location other than the case, so as to reduce the weight of the case and increase the volume of the case available for other contents. The releasable means for the handle may include a bracket member which is permanently secured to the case, in conjunction with a manually actuated member. The retractable handle includes an attachment portion for selective cooperative engagement with the manually actuated member to establish the first operative condition when the retractable handle is engaged and fixedly secured to the case.

As another advantageous feature in accordance with the present invention the elongated roller assembly which is mounted to the bottom of the computer case may likewise be disconnected from the case when it is desired to use the case in the non-rolling mode. A second releasable means is provided for securing the elongated cylindrical roller to the case. The second releasable means is manually movable between a first condition wherein the elongated cylindrical roller is engaged and fixedly secured to the bottom of the case and a second condition wherein the elongated roller may be removed from the case. Thus, under those conditions when it is desired to use the case in the non-rolling mode the cylindrical roller assembly may be moved therefrom to reduce the weight of the case, and facilitate its storage when it has been placed in the overhead bin in an airplane cabin.

Although not to be considered as limiting, the portable carrying case may be in the order of 16" wide and 12" high. One embodiment may typically be in the order of 4" deep. Another embodiment, which includes additional storage compartments, may be in the order of 6" deep. The cylindrical roller means along the bottom wall of the case may have an outer diameter in the order of one half to three quarters of an inch. This is significantly less than the individual wheels typically utilized in conjunction with other wheeled articles of luggage.

It is therefore a primary object of the present invention to provide a compact portable carrying case which includes a narrow roller bar along its bottom wall and can be readily converted into a rolling case.

Yet a further object of the present invention is to provide such a portable carrying case which may contain a laptop computer and includes a retractable handle, which can be completely stored within the case in its inoperative position, and an elongated roller extending along the long edge of the bottom wall of the carrying case.

Yet another object of the present invention is to provide such a portable carrying case in which the retractable handle may be manually disconnected when it is not desired to roll the case along the ground surface.

Still another object of the present invention is to provide such a portable carrying case in which the retractable handle includes a single vertical extensible member formed of telescoping sections, which can be completely enclosed within an externally accessible pocket of the portable carrying case.

Yet another object of the present invention is to provide such a portable carrying case in which the elongated roller is mounted to the bottom wall at its intersection with the back wall and is a unitary assembly extending along at least the major extent of the long edge of the bottom wall.

Yet an additional object of the present invention is to provide such a portable carrying case in which the elongated roller may be manually disconnected from the case when it is not desired to roll the case along the ground surface.

Yet a further object of the present invention is to provide such a portable carrying case formed of soft sided material having an enclosed volume which may include cushioning material for protecting the laptop computer.

These as well as other objects of the present invention will become readily apparent upon a consideration of the following description and drawings.

BRIEF DESCRIPTION OF THE DRAWINGS

FIG. 6 is a bottom view of an alternative embodiment of the portable carrying case.

FIG. 7 is a cross sectional view along the line 7—7 shown in FIG. 6 and looking in the direction of the arrows.

FIG. 8 is a cross-sectional view along the line 8—8 shown in FIG. 6 and looking in the direction of the arrows.

Figure 1:
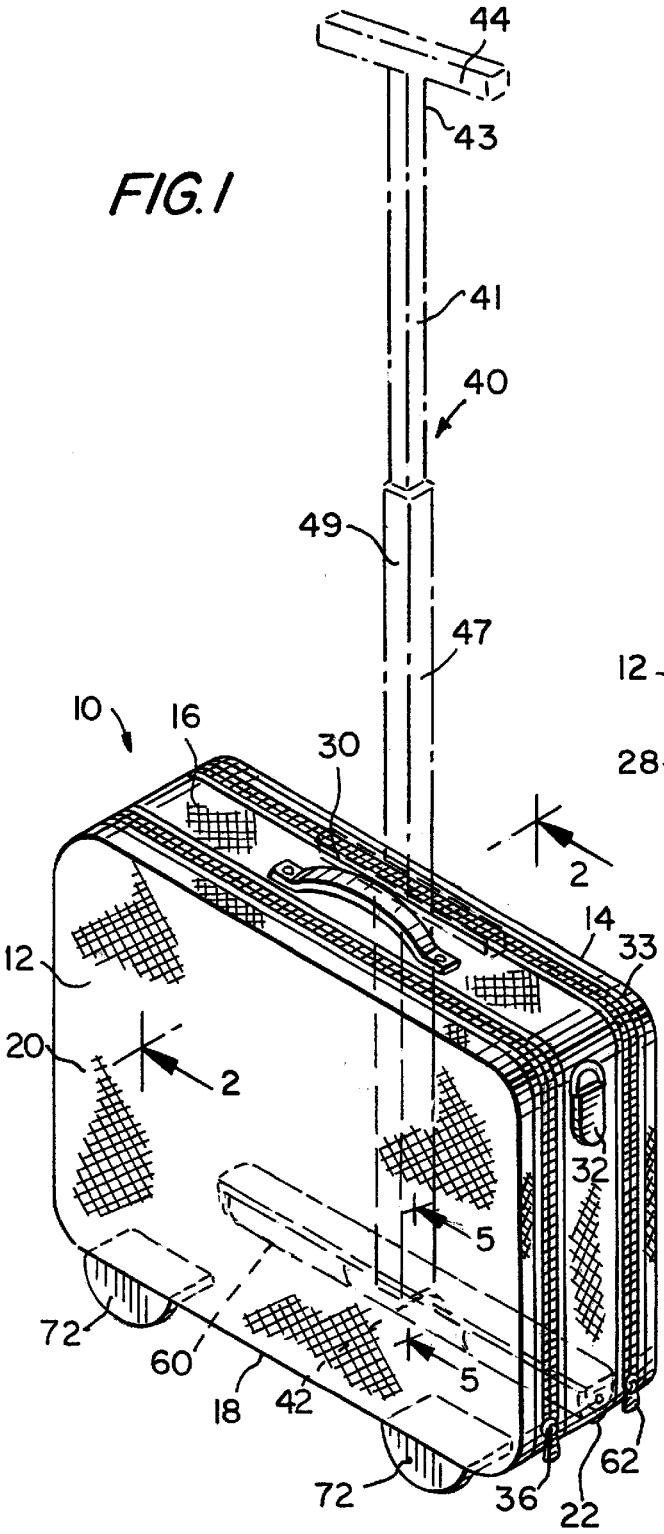
FIG. 1 is a perspective view of one embodiment of the portable carrying case in which the retractable handle is in the stored position but is shown dash-dotted in its operative position.
Figure 2:
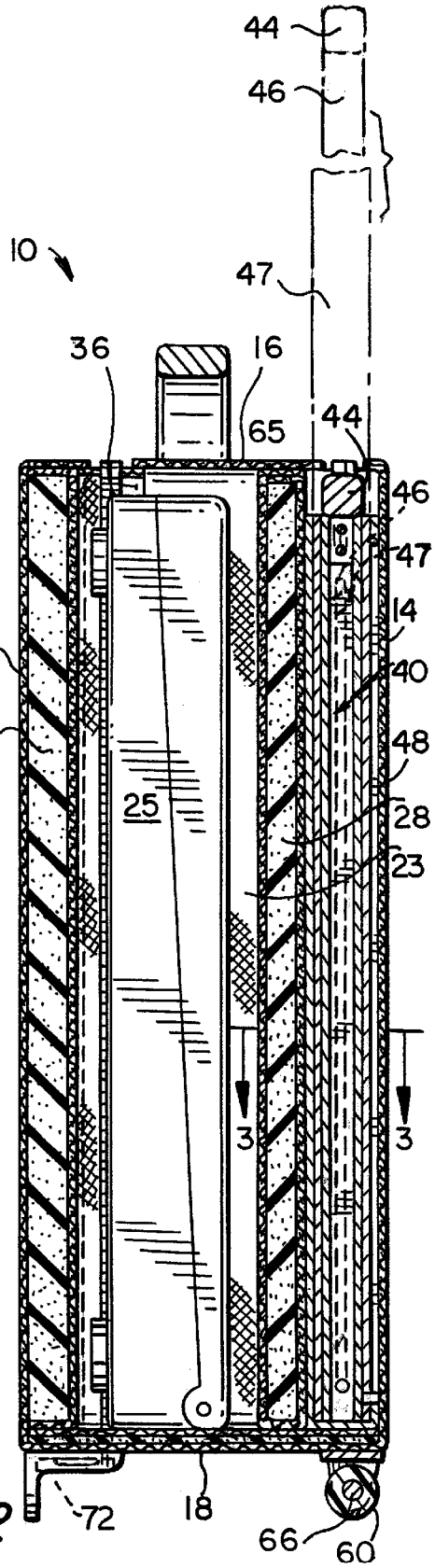
FIG. 2 is a cross-sectional view along the line 2—2 shown in FIG. 1 and looking in the direction of the arrows.
Figure 3:
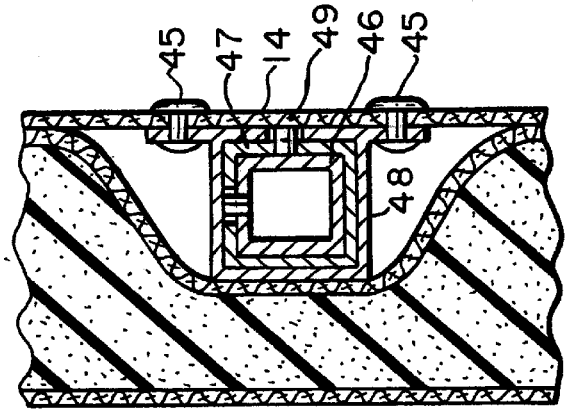
FIG. 3 is a cross-sectional view along the line 3—3 shown in FIG. 2 and looking in the direction of the arrows.
Figure 4:
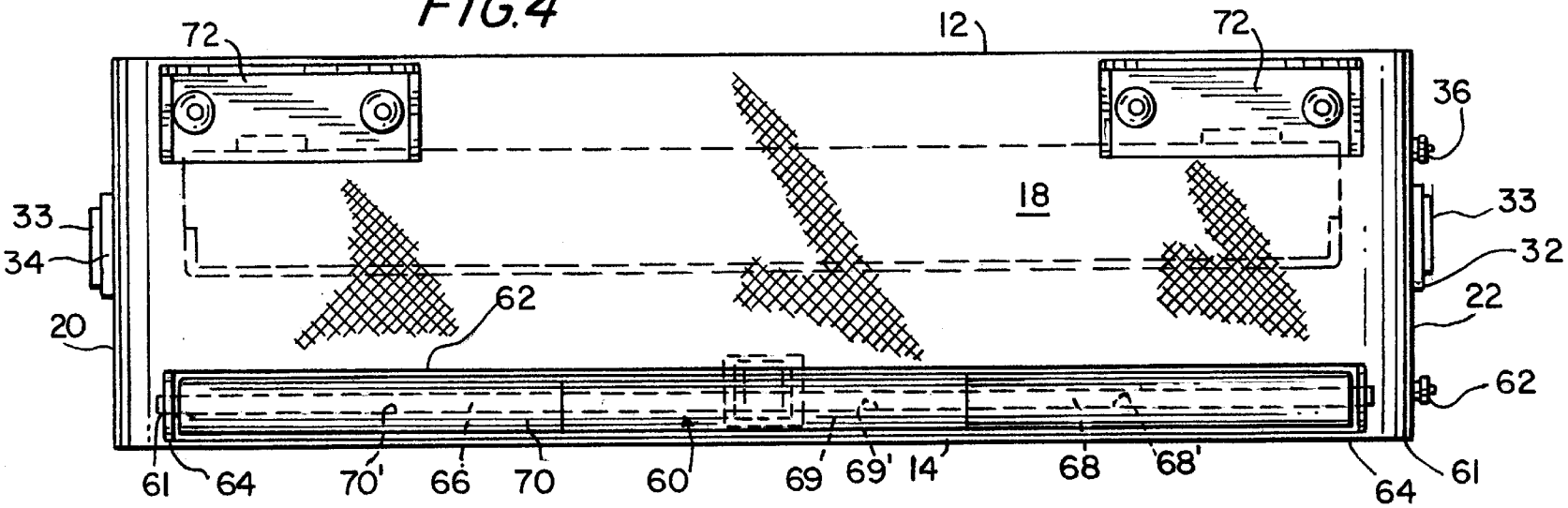
FIG. 4 is a bottom view of the portable carrying case.

Referring initially to FIGS. 1–5, portable carrying case 10 includes opposed front and back walls 12–14, top and bottom walls 16, 18, and opposed end walls 20–22. These external walls collectively define an enclosed volume, may be configured to compactly contain a laptop computer 25, as shown in FIG. 2. It should, however, be understood that case 10 may be configured to receive other contents. The aforedescribed walls are preferably formed of a soft but rugged fabric material, such as canvas, vinyl, or leather and may include cushioning material, shown as 28, for protecting the laptop computer against jarring and/or dropping. Additional protection (not shown) may be provided by the protective devices shown in my U.S. Pat. Nos. 5,529,184 and 5,622,262.

When it is desired to utilize the case 10 in its conventional mode, a manually graspable handle 30 is provided as well as side attachment brackets 32, 34 which include a D-ring 33 for the attachment of a conventional type of shoulder strap (not shown).

Manual access to the interior volume of the portable carrying case 10 for insertion and removal of the contents, such as a laptop computer may be provided by a zipper 36.

In accordance with the present invention, a removable retractable handle assembly 40 is provided. The handle assembly 40 extends into and through the interior volume of the case. The handle assembly has a first end 42 which is secured to the case at the bottom wall 18 by stiffening member 74, as will subsequently be discussed in conjunction with FIG. 5. The opposite end 43 of the retractable handle assembly has a handle 44 secured thereto. The handle assembly 40 includes telescoping sections 46, 47 which can telescope upwardly with respect to removable section 48. Each of the telescoping sections is of a length, comparable to, but less than, the extent between the top and bottom walls 16 and 18, such that when they are connected to the case and in their retracted storage position, as shown in FIG. 2, the handle assembly 40 may be completely confined within the enclosed volume of the case 10. However, in their extended position, the removable handle assembly 40 will be of an overall length approximating three times the distance between top and bottom walls 16, 18. The handle assembly 40 preferably includes a lock release button 49 to maintain the assembly in the extended operative position, and manually release same, so as to permit it to be retracted into its storage condition shown in FIG. 2.

In accordance with an advantageous feature of one form of the present invention, the retractable handle assembly 40 may be located within, and extend outwardly from a handle storage compartment 65 having a manually operable closure means, which may preferably be in the form of a zipper 62. Alternatively, a flap (not shown) may be provided, which is closed by a snap, or Velcro pressure sensitive fastener. Thus, when the handle assembly 40 is connected to and completely retracted within the portable carrying case 10, it will be enclosed within its compartment 65 and preferably not be visible from the exterior of the case, when it is desired to manually carry the portable carrying case without the employment of the rolling feature.

Figure 5:
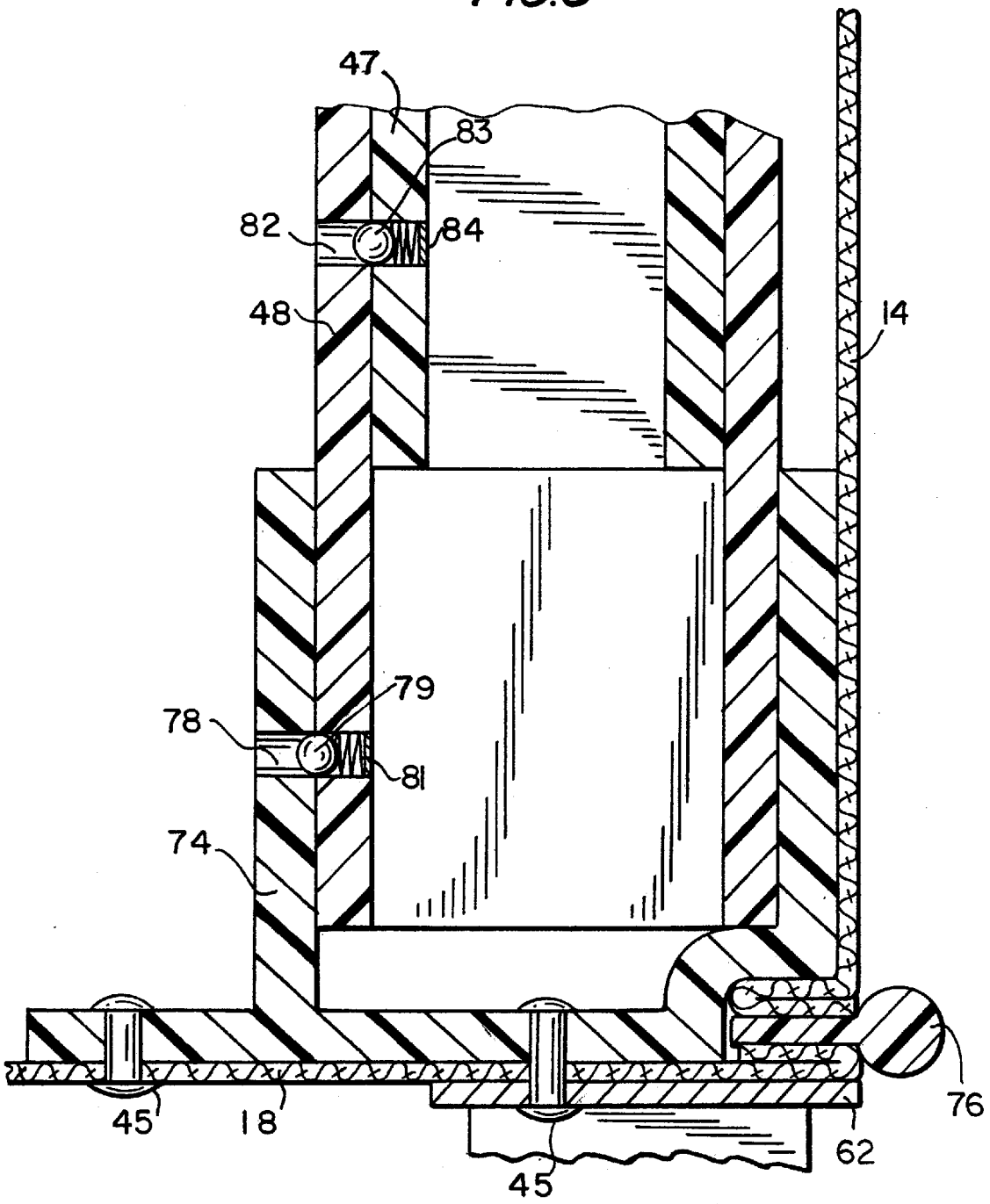
FIG. 5 is a cross-sectional view along the line 5—5 as shown in FIG. 1 and looking in the direction of the arrows.

Reference is now made to FIG. 5 which shows a preferable structure for the mounting of the retractable handle assembly to the portable carrying case. The removable retractable handle assembly, which includes telescoping sections 47 and 46 and stationary section 48 is secured to the stiffening member 74, which may be typically formed of hard plastic. The stiffening member 74 is secured to the bottom wall 18 of the case by rivets 45, which also preferably connect a bracket support 63 for the elongated roller assembly 60. The stiffening element 74 preferably includes a recessed portion in its outermost corner to accommodate an outer decorative bead trim 76 of the portable carrying case. Section 48 of the handle assembly is connected to member 74 by a spring biased ball detent assembly which includes ball 79 and expansion spring 81 carried by handle section 48, and cooperating detent opening 78 in the stiffening member 74. Likewise, the stationary section 48 is connected to a telescoping section 47 by a similar detent assembly which includes ball 83, expansion spring 84, and detent opening 82. In accordance with an advantageous feature of this embodiment, the expansion spring 81 is of a predetermined lesser force than expansion spring 84, such that when the retractable handle assembly 40 is pulled upward with sufficient force, members 79, 78 will be disengaged, while members 83, 82 remain in engagement. This permits the entire retractable handle assembly 40 (including sections 48, 47, and 46) to be manually removed from the portable carrying case when it is desired to utilize the case in the conventional prior art mode of operation in which the user will not be rolling the portable carrying case 10 along the ground surface. The handle assembly 40 may then be retracted and stored in compartment 65. When it is required to modify the mode of operation to roll the computer case, section 48 of the retractable handle assembly 40 is then reinserted within stiffening element 74, and moved downward such that spherical member 79 re-engages the detent opening 78. It should however be understood that other arrangements for manually disassembling, and re-attaching the retractable handle 40 to the portable carrying case can be employed, and that the arrangement shown in FIG. 5 is for illustrative purposes only. For example, the lower portion of stationary handle section 48 can have an external screw thread and stiffening member 78 a cooperating internal thread.

A cylindrical roller assembly is preferably provided by an elongated roller 60 mounted along one of the long edges of the bottom wall 18, shown in the present embodiment at the intersection of that edge with the back wall 14. The elongated roller will preferably be a unitary assembly extending at least along the major extent of this long edge between the end walls 20 and 22. The elongated roller assembly 60 includes a bracket support 63, which the embodiment of FIGS. 1–5 is of a length generally corresponding to the length of the elongated roller. The bracket support includes downwardly turned ears 64 at its end extremes with a central aperture 61 to support a roller axle 66. The roller axis is rotatable within the apertures 61 of the ears 64. The elongated roller includes an elongated cylindrical roller means, which preferably includes successive aligned sections 68, 69, and 70 having a central aperture 68', 69', 70' extending therethrough, which will be in press fit frictional engagement with the outer diameter of the axle 66. Thus, the individual sections 68, 69, 70, when moved along a floor surface, will rotate in unison without the axle 66, which is supported in ears 64. The roller assembly may preferably be manually removable, as shown by subsequently discussed roller assembly 160 of FIGS. 15–16. A splash plate (not shown) may also be added along the bottom wall 18 of the carrying case to provide protection while it is being rolled along the ground surface.

A pair of downwardly extending, generally L-shaped support feet 72 may be mounted to the edge of the bottom at its intersection with the front wall 12 of the case, and are preferably proximate the end extremes, 20 and 22. Feet 72 provide balance and support of the case along the bottom wall, as shown in FIG. 1, when the case is stationary with respect to the floor surface and the handle assembly 40 is in its operative pulled-out position.

When it is desired to move the portable carrying case along the floor surface, the handle assembly 40 is either (i) re-attached to the stiffening member 74, or (ii) if within storage compartment 65, it will be pulled outward above the top wall 16 of the portable carrying case. The case is then tilted backward, and moved along by the roller assembly 60.

While not intended as limiting the present invention, the portable carrying case of the embodiment may typically be in the order of 16" wide, 12" high, and 4" deep. The elongated roller 60 may typically have an outer diameter in the order of one half to three quarters of an inch. Thus, modifying the portable laptop carrying case to permit rolling the case along a floor surface requires a minimal increase in the weight, profile, or general aesthetics of the case. When used in the conventional mode, for hand carrying with the manual handle or shoulder strap, the handle assembly 40 may be disconnected from the case.

FIGS. 6–8 show a modification of the previously described embodiment. FIG. 6 is a bottom view generally corresponding to FIG. 4 of the prior embodiment, and in which corresponding components are designated by the same numerals. FIGS. 7–8 are cross-sectional views of FIG. 6, as shown therein, to provide further details of this embodiment. This embodiment differs from the prior embodiment in two principal ways. They are:

(a) the case includes an additional compartment 90 which is alongside the compartment 23 configured for containing the laptop computer 25; and (b) the bracket 62-1 for the mounting of the elongated roller assembly 60 (which includes successive aligned cylindrical roller sections 68, 69, and 70) includes downwardly turned ears 64-1 which are spaced along an intermediate region of the supporting bracket.

The location of the supporting ears 64-1 along an intermediate region of the case, and specifically between the junctures of roller sections 70-69 and 69-68 advantageously make the roller assembly less conspicuous when the carrying case is being utilized in its conventional, non-rolling, mode of operation. Further, should the roller move over an obstruction along the ground surface which will flex its supporting rod 66 it is less apt to move out of the apertures provided in the ears.

The portable carrying case shown in FIGS. 6–8 may also typically be in the order of 16" wide and 12" high. However, by virtue of its additional compartment 90, it may be in the order of 6" wide. Because of this additional width, it has been determined that feet 72 of the prior embodiment may be replaced by a plurality of molded support members 72-1 within the interior of bottom wall 18. Support members 72-1 each have a plurality of downwardly extending elements 72-2 (shown in FIG. 7) which may be of a lesser extent than feet 72 shown in the prior embodiment.

Figure 10:
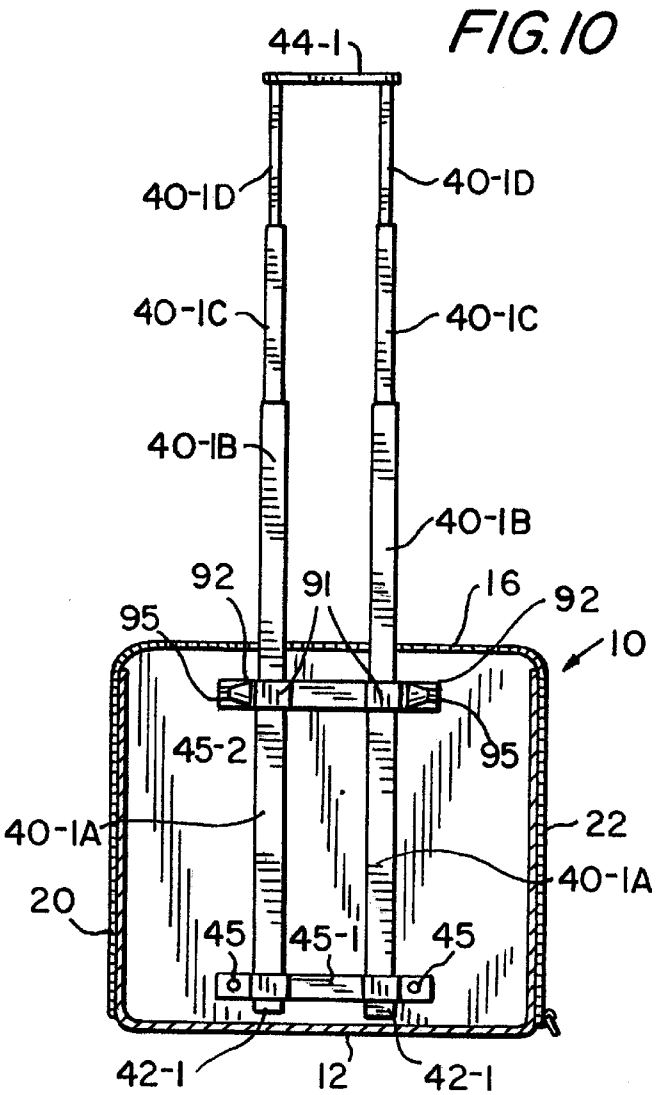
FIG. 10 is a view along the arrows 10—10 as shown in FIG. 9 and looking in the direction of the arrows.
Figure 9:
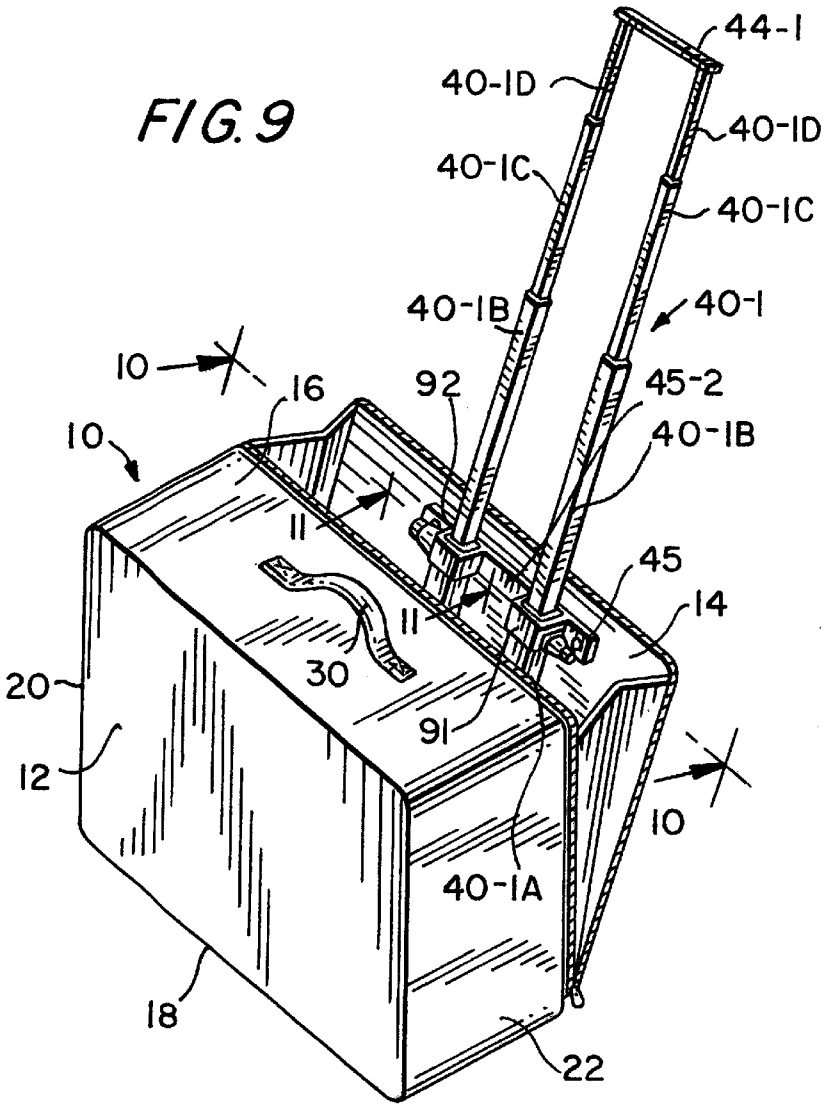
FIG. 9 is a perspective view of another embodiment of the portable carrying case in which the retractable handle assembly may be manually removed from the case.
Figure 11:
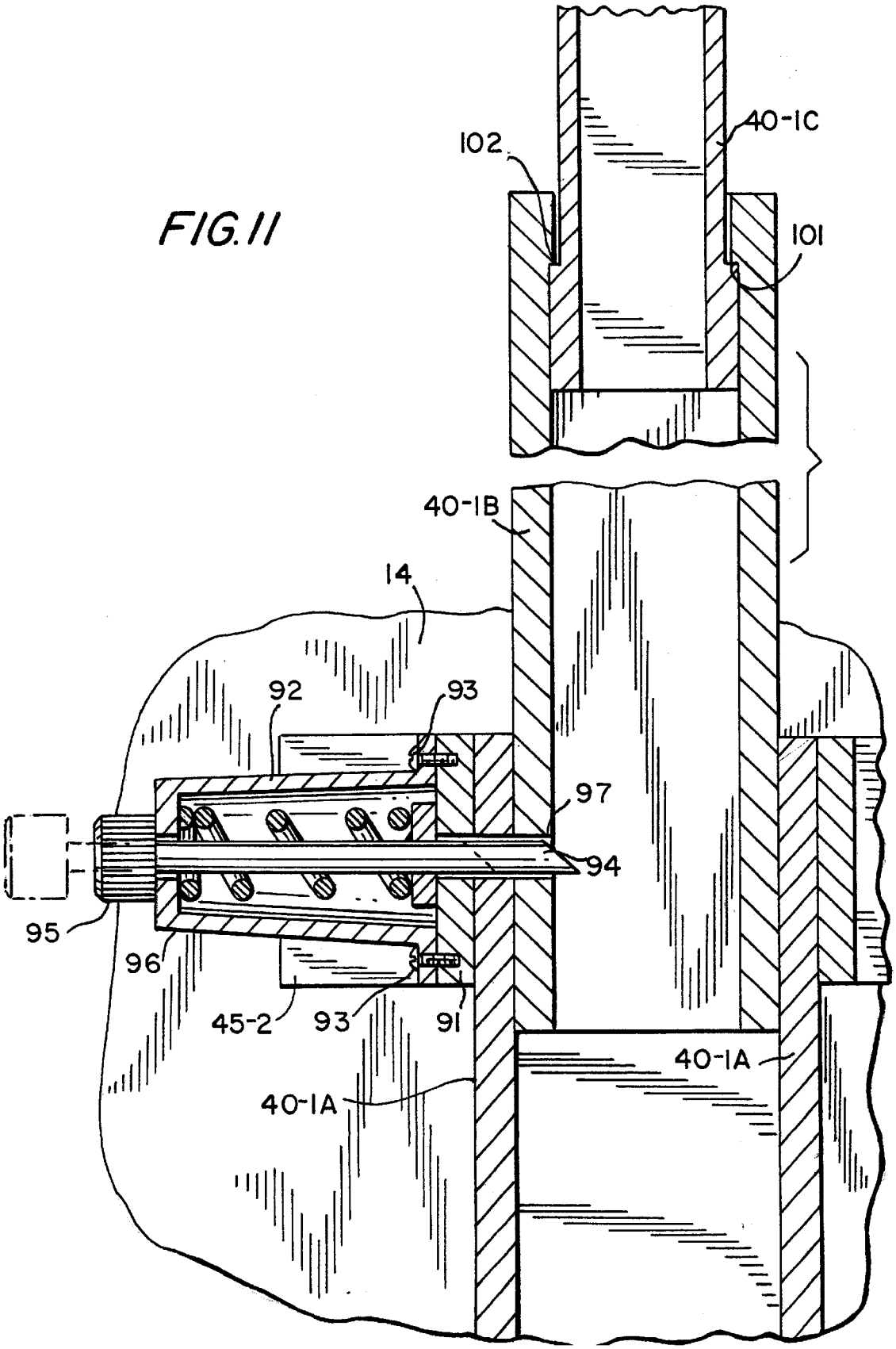
FIG. 11 is a cross-sectional view along the line 11—11 as shown in FIG. 9 and looking in the direction of the arrows.

Reference is now made to FIGS. 9–11 which show a modified embodiment of the present invention and in which those components corresponding to like components in the prior embodiments are similarly numbered. The portable carrying case 10 which includes back walls 12–14, top and bottom walls 16, 18 and opposed ends walls 20, 22 includes a retractable handle assembly 40-1 which may be entirely removed from the case 10. For purposes of simplicity the roller assembly, such as 60 of the prior embodiments, has been omitted, with it being understood that it would be naturally included in the complete case shown in FIGS. 9–11. Alternatively, the removable roller assembly 160 of the subsequently to be discussed embodiment of FIGS. 15–16, may be included.

The removable retractable handle assembly 40-1 includes telescoping sections 40-1A, 40-1B, 40-1C and 40-1D, with section 40-1A extending into and through the interior of the case 10 between the top and bottom walls 12–16. A manually graspable handle 44-1 is provided at the outward extent of section 40-1D. When the handle assembly is in the fully extended position the vertical movement between sections 40-1C and 40-1B is limited by the engagement of shoulders 101–102 (see FIG. 11). By virtue of the removable handle assembly extending into and through the case, each of its telescoping sections 40-1B, 40-1C, and 40-1D may be of a comparable length. This advantageously provides an extended handle length which easily permits rolling of the case without having the user stoop down towards the case. The vertical movement between sections 40-1C and 40-1D may be similarly limited by the engagement of cooperating shoulders within those sections of the handle assembly 40-1 (not shown).

In accordance with the present embodiment only section 40-1A is permanently secured to the rear wall 14 of the case by vertically spaced bracket members 45-1 and 45-2, with these bracket members being secured to the rear wall 14 of the case by rivets 45. Bracket 45-2 includes a releasable means assembly at each of its sides which includes a housing 96 mounted to generally U-shaped members 91 by screws 93. Each housing 96 includes a generally horizontally movable pin member 94 which is normally biased to the condition shown in the solid lines of FIG. 11 by spring 98. In this condition its forward end engages aperture 97 in handle assembly member 40-1B to maintain each of the handle members 40-1B in their respective outermost telescoping member 40-1A. This establishes the condition wherein the hand assembly 40-1 is engaged by the releasable means, and fixedly secured to the wall 14 of the case.

Should it be desired to remove the handle assembly 40-1, each of the manually graspable members 95 are moved to their dotted condition as shown in FIG. 11, thereby releasing the forward end of pin 94 from aperture 97, such that the telescoping section 40-1B, and hence 40-1C and 40-1D contained therein, may be completely removed from the case 10. Thus should it be desired to use the case in the conventional mode, when it could be hand carried by strap 30, the removal of sections 40-1B, 40-1C, and 40-1D naturally lightens the weight of the case, and provides additional volume for the reception of contents therein.

Figure 12:
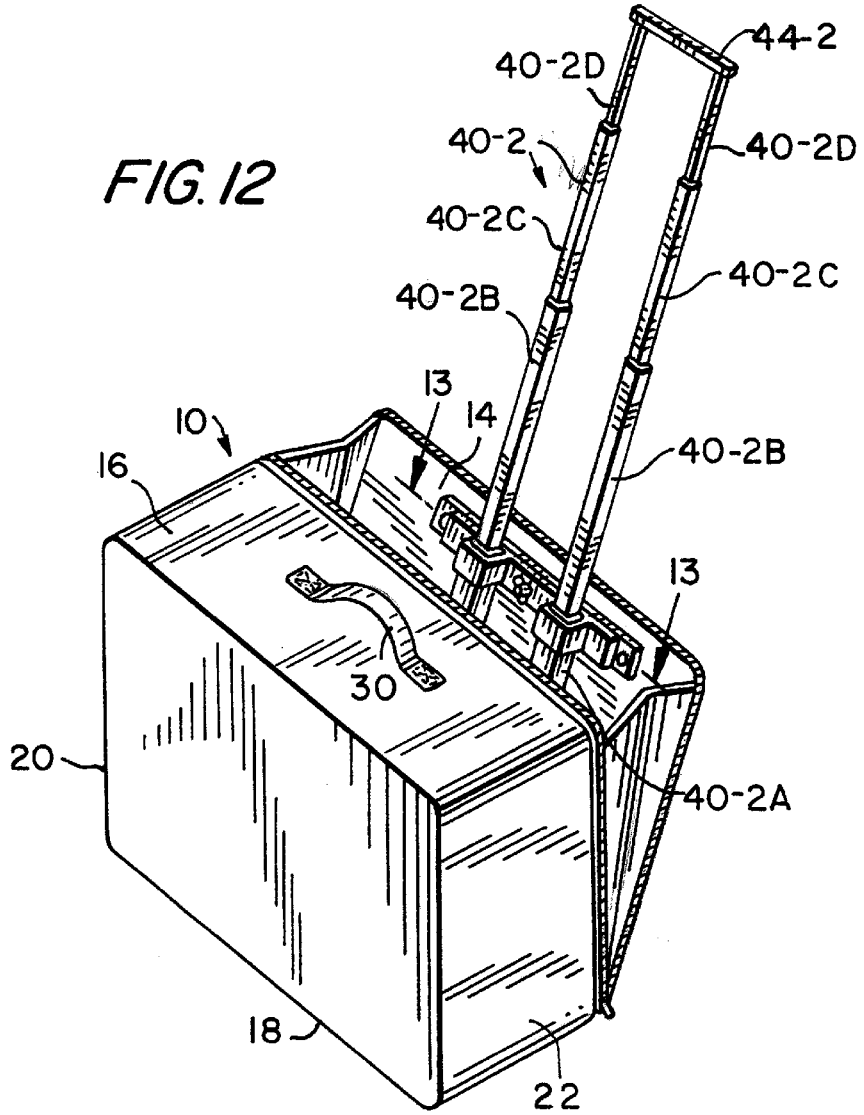
FIG. 12 is a perspective view of another alternative embodiment of the case in which the retractable handle assembly may be manually disconnected from the case.
Figure 13:
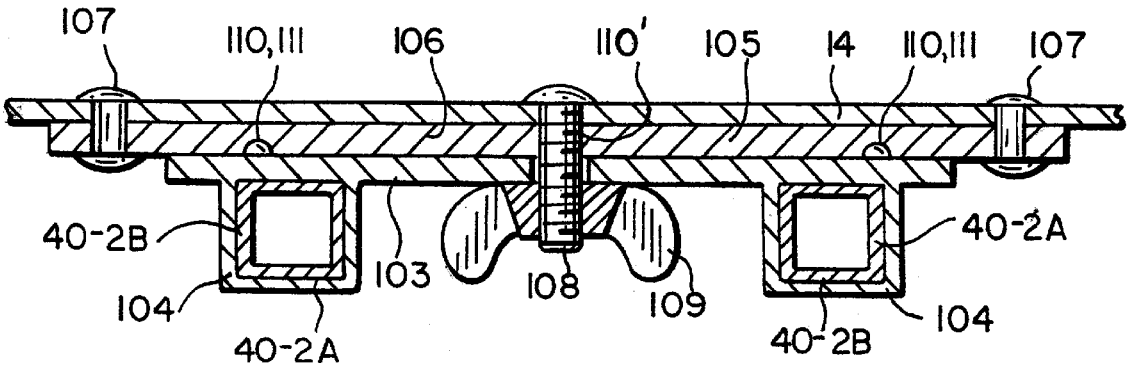
FIG. 13 is a cross-sectional view along the lines 13—13 as shown in FIG. 12 and looking in the direction of the arrows.
Figure 14:
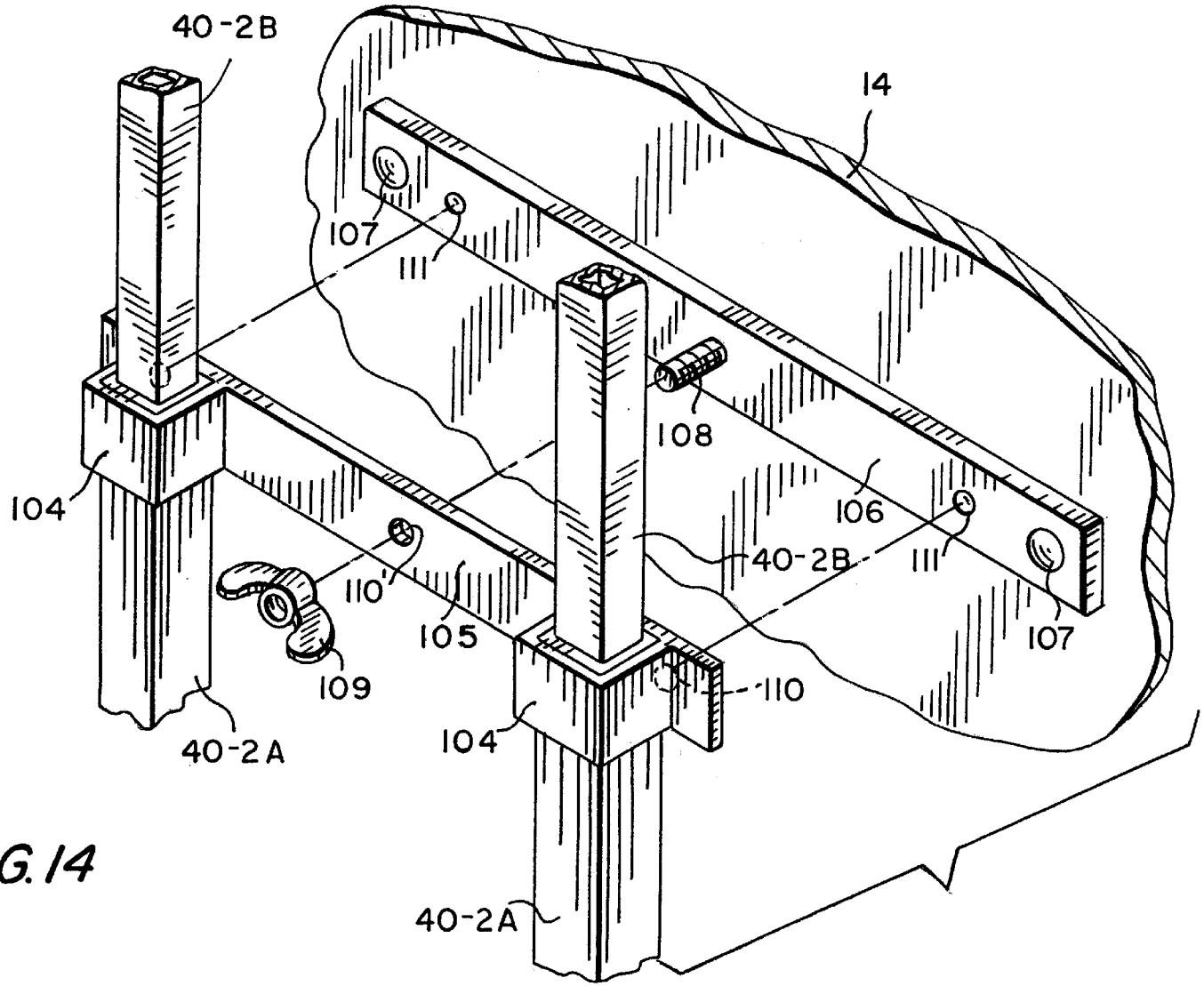
FIG. 14 is an exploded perspective view of a portion of the manually releasable handle connection of the embodiment shown in FIGS. 12 and 13.

Reference is now made to FIGS. 12–14 which show an alternative structure for the removable connection of retractable handle assembly 40-2 to the case 10. As in the embodiment of FIGS. 9–11, the cylindrical roller 60 or 160, shown in detail in the embodiments of FIGS. 1–8 and 15–16, is not included for purposes of simplicity, it being understood that roller assembly 60 or 160 will be included in the completely assembled embodiment of FIGS. 12–14.

The rear wall 14 of the case 10 has a bracket member 106 permanently secured thereto by rivets 107. Bracket member 106 includes a central threaded projection 108. The handle assembly 40-2, comprising telescoping elements 40-2A, 40-2B, 40-2C, and 40-2D, with handle 44-2 at its free end, is held by bracket 105 as was the situation with the other embodiments, another telescoping section will extend downwardly beyond bracket 106 towards it the bottom wall 18 of the case. Its lower end will be inserted in a bracket similar to bracket 45-1 shown in FIG. 10. A cooperating bracket 105 is attached to the removable handle assembly. Bracket 105 includes outboard U-shaped portions 104 which securably hold outer telescoping sections 40-2A. Bracket 105 includes a central aperture 110' which is of a suitable size to receive the central threaded projection 108. To assist in positioning bracket 105 on bracket 106 when it is desired to connect the handle assembly 40-2 to the case 10, bracket 105 may include a pair of spaced dimple-like projections 110 which are intended to be received within complementary depressions 111 within bracket 106. To connect the handle assembly 40-2 to the case 10, bracket 105 is placed in engagement with bracket 106, with threaded member 108 passing through aperture 110', and elements 110, 111 being in engagement. The wing nut 109 is then manually rotated on the threaded shaft 108 to maintain these parts in their fastened condition. Conversely, when it is desired to remove the handle assembly 40-2 the wing nut 109 is rotated in the opposite direction, thereby permitting the displacement of brackets 105–106.

Figure 15:
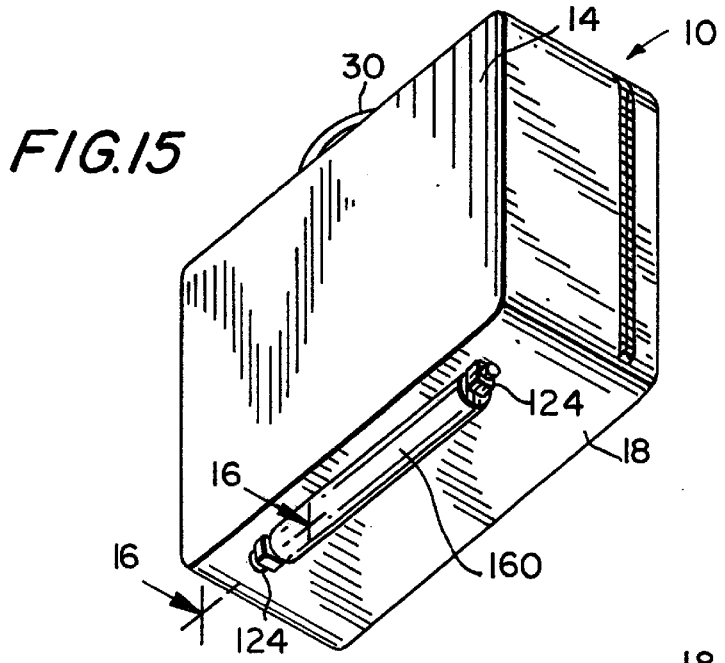
FIG. 15 is an exploded perspective view showing a further modification of the case in which the cylindrical roller assembly may be manually removed therefrom.
Figure 16:
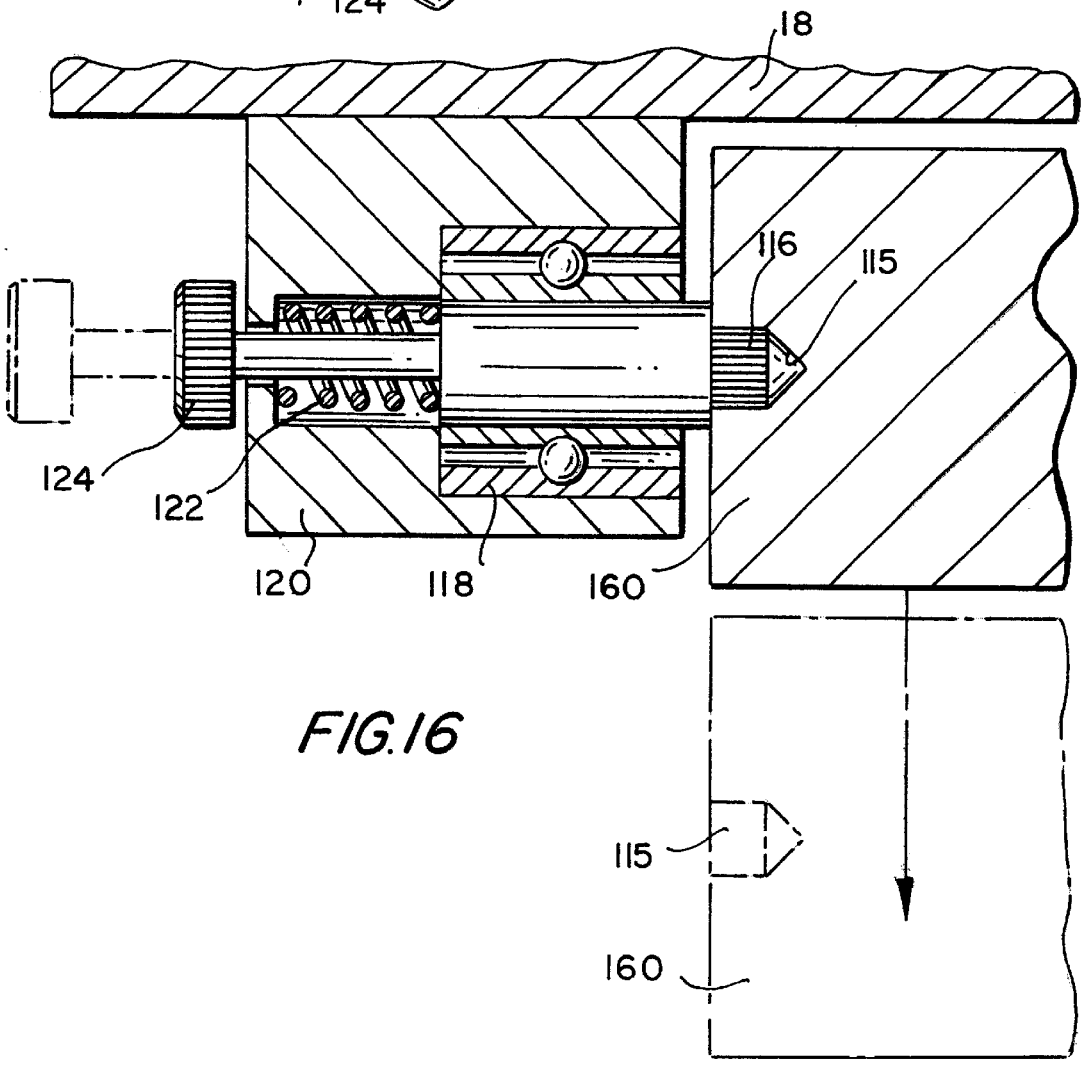
FIG. 16 is a cross-sectional view along the arrows 16—16 as shown in FIG. 15 and looking in the direction of the arrows.

Reference is now made to FIGS. 15 and 16 which show a further modification of the present invention, which can be utilized in conjunction with any of the aforedescribed embodiments, and in which the cylindrical roller assembly 160 may be manually removed from the bottom wall 18 of case 10 when it is desired to use the case 10 in the non-rolling mode, as by carrying with handle 30 or a shoulder strap (not shown). The cylindrical roller assembly 160 includes an aperture 115 at each of its ends which is adapted to receive the forward projecting spline 116. Spline 116 is rotationally supported within bearing 118 contained within housing 120 and is biased to the condition shown in the solid lines in FIG. 16 by biasing spring member 122. Should it be desired to release cylindrical roller assembly 160 from the bottom of case 18, the manual handle 124 at each end of the roller assembly is manually grasped and moved outward, to the dotted condition shown in FIG. 16. This releases the splines 116 from their apertures 115, permitting the removal of the cylindrical roller assembly 160.

Accordingly under those conditions when it is desired to utilize the case 10 in a non-rolling mode of operation the cylindrical roller assembly 160 may be removed, as shown in the embodiments of FIGS. 15 and 16. At the same time, the retractable handle assembly of the embodiments shown in FIGS. 5, 9–11, or 12–14 may also be removed.

Although the present invention has been described in conjunction with preferred embodiments, it should naturally be understood that this is for illustrative purposes only and various modifications may be made thereto without departing from the spirit and scope of the invention, which is defined by the appended claims.

I claim:

1. A portable carrying case comprising:

opposed front and back walls, opposed top and bottom walls and opposed first and second end walls to collectively define an enclosed volume;

means for manually operably accessing said enclosed volume, said means extending along one side of said walls to provide access to said enclosed volume for the insertion and removal of contents from within said enclosed volume;

a removable and telescopically retractable handle assembly extending into and through said enclosed volume, substantially between said opposed top and bottom walls;

said removable handle assembly having a first section removably secured within said enclosed volume, and a free end;

said removable handle assembly having a removed condition in which said removable handle assembly is separated from said case, and an operative condition in which said first section is secured within the enclosed volume of said case and said free end extends upwardly beyond said top wall, and manually operable release means for moving said retractable handle assembly between said operative and removed conditions;

first releasable means for securing said first section of the handle assembly to a wall of the case, said first releasable means including a bracket member permanently secured to said case and a manually actuated member, said first section including an attachment portion for selective cooperative engagement with said manually actuated member;

said bottom wall being of a generally rectangular shape, including opposed first and second long edges and opposed first and second short edges; an elongated cylindrical roller mounted in juxtaposition to one of said long edges, at its intersection with one of said back or front walls;

said removable handle assembly in its operative position telescoped upwardly substantially beyond said top wall and adapted to translate said elongated roller along a floor surface for rolling said case along the floor surface.

2. A portable carrying case as set forth in claim 1, wherein said removable handle assembly in its operative condition telescoped upwardly of said top wall by a length exceeding the distance between said top and bottom walls.

3. A portable carrying case as set forth in claim 2, wherein said removable handle assembly includes a plurality of telescoping sections, each section of a length generally corresponding to the distance between said top and bottom walls.

4. A portable carrying case as set forth in claim 1, further including a manually defeatable securing means for the securement of said first section of said removable retractable handle assembly to said case.

5. A portable carrying case as set forth in claim 1, wherein said elongated roller is a unitary assembly having opposed first and second ends and extends at least along the major extent of said long edge between said first and second end walls, said case further comprising roller support means for supporting said elongated cylindrical roller in depending relationship to said bottom wall, said support means including end supports for said first and second ends and an intermediate support for supporting said elongated cylindrical roller at an intermediate region between its first and second ends.

6. A portable carrying case as set forth in claim 1, wherein said enclosed volume is configured to compactly contain a laptop computer.

7. A portable carrying case as set forth in claim 1, wherein said elongated roller is a unitary assembly extending along an edge of said bottom wall, between first and second end wall.

8. A portable carrying case as set forth in claim 1, wherein said removable handle assembly is confined within said enclosed volume in a retracted position.

9. A portable carrying case as set forth in claim 1, wherein said elongated cylindrical roller has an outer diameter of about one-half to three-quarters of an inch.

10. A portable carrying case as set forth in claim 1, wherein said case is about 16 inches wide and about 12 inches high and is configured to contain a laptop computer.

11. A portable carrying case as set forth in claim 1, including a second releasable means for removably securing said elongated cylindrical roller to said case, said second releasable means being manually movable between a first condition wherein said elongated cylindrical roller is engaged and fixedly secured to said case, and a second condition wherein said elongated cylindrical roller is removable from said case.

12. A portable carrying case as set forth in claim 11, wherein said second releasable means includes a biasing spring.

13. A portable carrying case as set forth in claim 1 wherein said manually actuated member includes a biasing spring.

14. A portable carrying case as set forth in claim 1 wherein said manually actuated member includes a threaded shaft, said attachment portion includes an aperture for said threaded shaft, and further including a rotatable closure nut for maintaining the engagement of said threaded shaft through said aperture.

15. A portable carrying case as set forth in claim 1, further including a handle storage compartment along said back wall and extending between said top and bottom walls, said handle storage compartment including a manually operable closure means at said top wall, and said first end of said retractable handle is secured to said case at the bottom wall end of said handle storage compartment.

16. A portable carrying case as set forth in claim 1, further comprising manually releasable means for selectively securing or removing said elongated roller from the case.

17. A portable carrying case as set forth in claim 16, wherein said manually releasable means includes a second releasable means for securing said elongated cylindrical roller to said case, said second releasable means being manually movable between a first condition wherein said elongated cylindrical roller is engaged and fixedly secured to said case, and a second condition wherein said elongated cylindrical roller may be removed from said case.

18. A portable carrying case as set forth in claim 17, wherein said second releasable means includes a biasing spring.

19. A portable carrying case as set forth in claim 16, wherein said support means includes a bracket support, said bracket support including first and second downwardly turned ears at said first and second ends of said elongated cylindrical roller and at least one intermediate downwardly turned ear between said first and second ends of said elongated cylindrical roller.

20. A portable carrying case as set forth in claims 16, wherein said elongated cylindrical roller includes first and second ends and a bracket support; said bracket support including a plurality of downwardly turned ears, including ears at said first and second ends and at least one intermediate ear between said first and second ends;

a roller axis supported by said ears, said roller axis extending through said ears to rotate said elongated cylindrical roller as the case is moved along the floor surface, with said intermediate ear supporting the intermediate region of said elongated cylindrical roller.

* * * * *